US011090570B1

(12) United States Patent
Hsiang

(10) Patent No.: US 11,090,570 B1
(45) Date of Patent: Aug. 17, 2021

(54) SWING FOR PLAYING IN STANDING POSTURE

(71) Applicant: Crowntec (Jiang Xi) Sports Technology Co. Ltd., Jiujiang (CN)

(72) Inventor: Li-Ju Hsiang, Jiujiang (CN)

(73) Assignee: CROWNTEC (JIANG XI) SPORTS TECHNOLOGY CO. LTD., Jiujiang (CN)

( * ) Notice: Subject to any disclaimer, the term of this patent is extended or adjusted under 35 U.S.C. 154(b) by 0 days.

(21) Appl. No.: 17/067,282

(22) Filed: Oct. 9, 2020

(51) Int. Cl.
*A63G 9/02* (2006.01)
*A63G 9/12* (2006.01)

(52) U.S. Cl.
CPC ..... *A63G 9/02* (2013.01); *A63G 9/12* (2013.01)

(58) Field of Classification Search
CPC ..... A63G 9/00; A63G 9/02; A63G 9/04; A63G 9/12; A63B 7/00; A63B 69/00; G09B 19/00
USPC ..... 472/118, 120–125; 482/70–71
See application file for complete search history.

(56) References Cited

U.S. PATENT DOCUMENTS

| | | | | |
|---|---|---|---|---|
| 6,932,710 | B1 * | 8/2005 | Hartin | A63B 7/00 472/118 |
| 9,511,296 | B2 | 12/2016 | Bertschy | |
| D778,381 | S | 2/2017 | Bertschy | |
| 9,833,680 | B2 * | 12/2017 | Claustre | A63B 69/0093 |
| D810,853 | S | 2/2018 | Bertschy | |
| 10,625,169 | B1 * | 4/2020 | Mayer | A63G 9/12 |

* cited by examiner

*Primary Examiner* — Kien T Nguyen
(74) *Attorney, Agent, or Firm* — Muncy, Geissler, Olds & Lowe, P.C.

(57) ABSTRACT

The invention provides a swing for playing in standing posture which comprises a step plate defined with two long sides and two short sides, and two suspension components. The suspension components are disposed on the long sides respectively. Each suspension component includes two slings disposed at one of the long sides, and a handle assembled with the two slings and parallel to the long sides. The handle comprises two through holes for the two slings to pass through, and the two slings do not wound around the handle at any part thereof. Each sling comprises a stop sleeve and a knot. The stop sleeve moves along the sling if a force bore by the stop sleeve is greater than the friction between the stop sleeve and a surface of the sling. A position of the handle on the sling is defined by the stop sleeve and the knot.

11 Claims, 9 Drawing Sheets

SWING FOR PLAYING IN STANDING POSTURE

FIELD OF THE INVENTION

The invention relates to a swing, and more particularly to a swing for playing in standing posture.

BACKGROUND OF THE INVENTION

The swing structure for users to swing in standing posture is disclosed in the U.S. Pat. No. 9,511,296B, D810853, and D778381. However, the aforementioned patents only provide the adjustable structure of the swing handle, but the conventional swing cannot wrap the handle with a simple winding method or a simple knot, causing the handle to be unable to withstand the grasping force of the user during implementation. In other words, the handle of the conventional swing must be wound by a special winding method so as to be securely fastened on the swing. However, the special winding method is difficult for the user to understand, which is not conducive to the user to reproduce the winding method again. In addition, if the user does not bind the handle properly, the assembly position of the handle can be shifted and the handle may even fall off. Furthermore, in the conventional method of winding and binding around the handle, during the process of adjusting the position of the handle, the knots wrapped around the two ends of the handle must be unknotted, and then slings are wound in order to fasten at the ends of the handle respectively, which is not convenient for the user to operate.

SUMMARY OF THE INVENTION

A main object of the invention is to solve the problem that the conventional structure cannot be reliably fastened.

In order to achieve the above object, the invention provides a swing for playing in standing posture. The swing comprises a step plate and two suspension components. The step plate is defined with two long sides and two short sides along edges thereof. The two suspension components are respectively disposed on the long sides, and each of the suspension components includes two slings disposed on one of the long sides of the step plate and a handle assembled with the two slings and parallel to the long sides. The handle is formed with two through holes for the two slings to pass through, wherein the two slings do not wound around the handle at any part thereof, and each of the two slings comprises a stop sleeve and a knot, the stop sleeve moves along the sling if a force bore by the stop sleeve is greater than a friction between the stop sleeve and a surface of the sling, and a position of the handle on the sling is defined by the stop sleeve and the knot.

In one embodiment, the stop sleeve comprises a sleeve and at least one stop ring connected with the sleeve, and the sleeve is sleeved on the sling and inserted into one of the two through holes.

In one embodiment, one of the two slings of each suspension component is provided with at least one bundling member which is disposed at a position higher than the handle to restrict one end of the other one of the two slings.

In one embodiment, one of the two slings provided with the bundling member is formed with a first sling loop at one end that is not assembled with the step plate, and the first sling loop is used to assemble with a hanging hook.

In one embodiment, the step plate is provided with two mounting rods passing through the step plate, and one end of each of the slings connecting with the step plate is provided with a connecting hook assembled with one of the mounting rods.

In one embodiment, one end of each of the slings which is close to the step plate is formed with a second sling loop to assemble with the connecting hook.

In one embodiment, the step plate is provided with two grooves parallel to the two long sides on a plane without facing the two handles, and two supporting ribs disposed in the two grooves respectively.

In one embodiment, the step plate is formed with an accommodating groove on the plane without facing the two handles, and the step plate comprises a light-emitting module disposing in the accommodating groove, and the step plate is made of a light-transmitting material.

In one embodiment, the light-emitting module includes a control unit disposed in the accommodating groove, and at least one light-emitting strip disposed in one of the two grooves, each of the supporting ribs is stacked on the light-emitting strip, and the light-emitting strip comprises a light-emitting surface facing the groove.

In one embodiment, two ends of the step plate respectively comprise an upward tilt angle while viewing the step plate from one of the long sides.

In one embodiment, the step plate is wavy, and two ends of the step plate respectively comprise an upward tilt angle while viewing the step plate from one of the long sides.

Through the foregoing implementation of the invention, compared with the prior art, the invention has the following features: the invention does not fasten with the handle by using the method with which the conventional sling winds around the handle, but instead using the stop sleeve and the knot provided on each of the slings to define a disposing position of the handle. In other words, when the user intends to change a position of the handle, the stop sleeve can be operated to move the stop sleeve upward and downward along the sling, thereby changing a position of the handle on the sling.

DETAILED DESCRIPTION OF THE PREFERRED EMBODIMENTS

Figure 1:
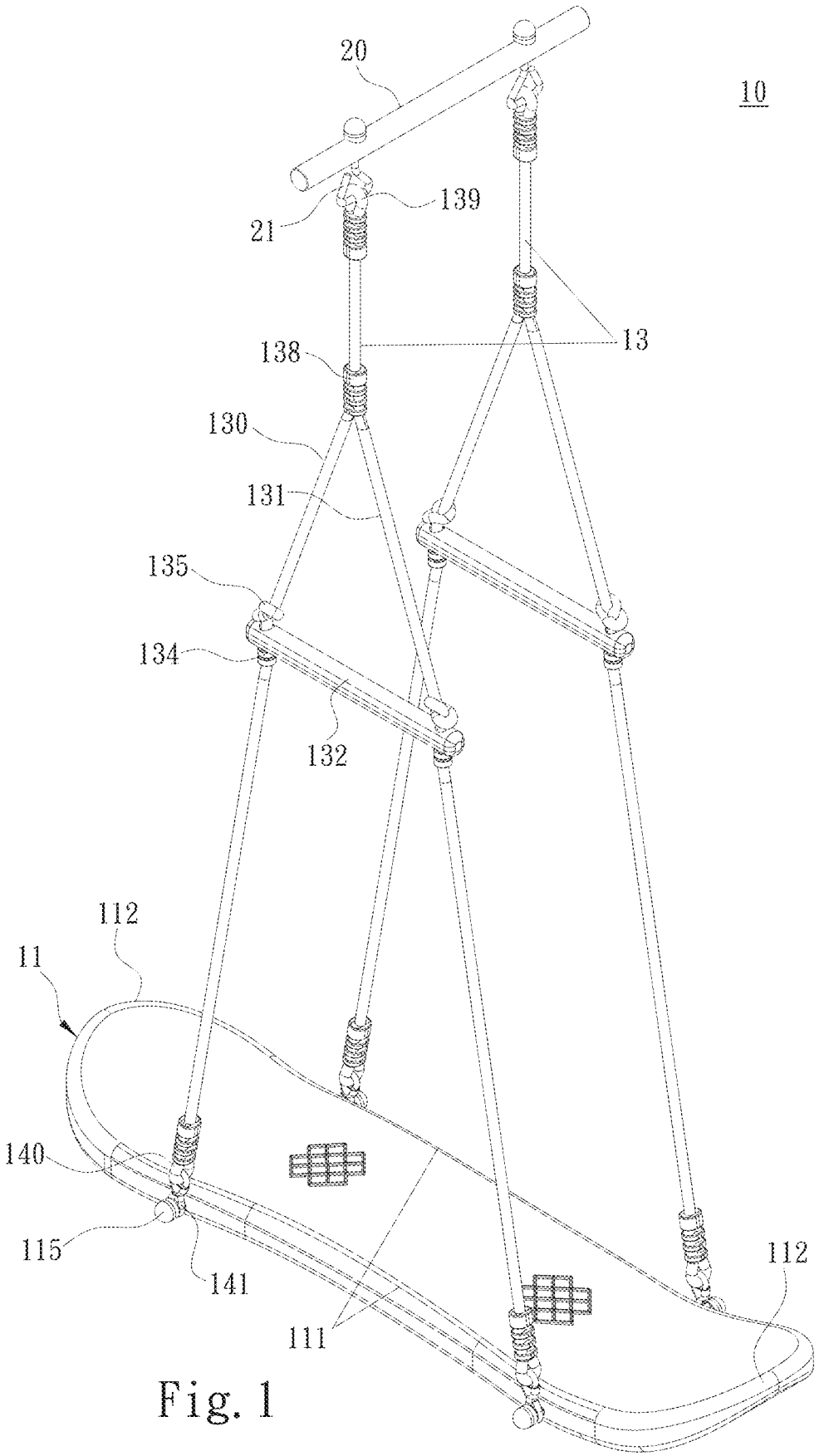
FIG. 1 is a perspective view of one embodiment of the invention.
Figure 2:
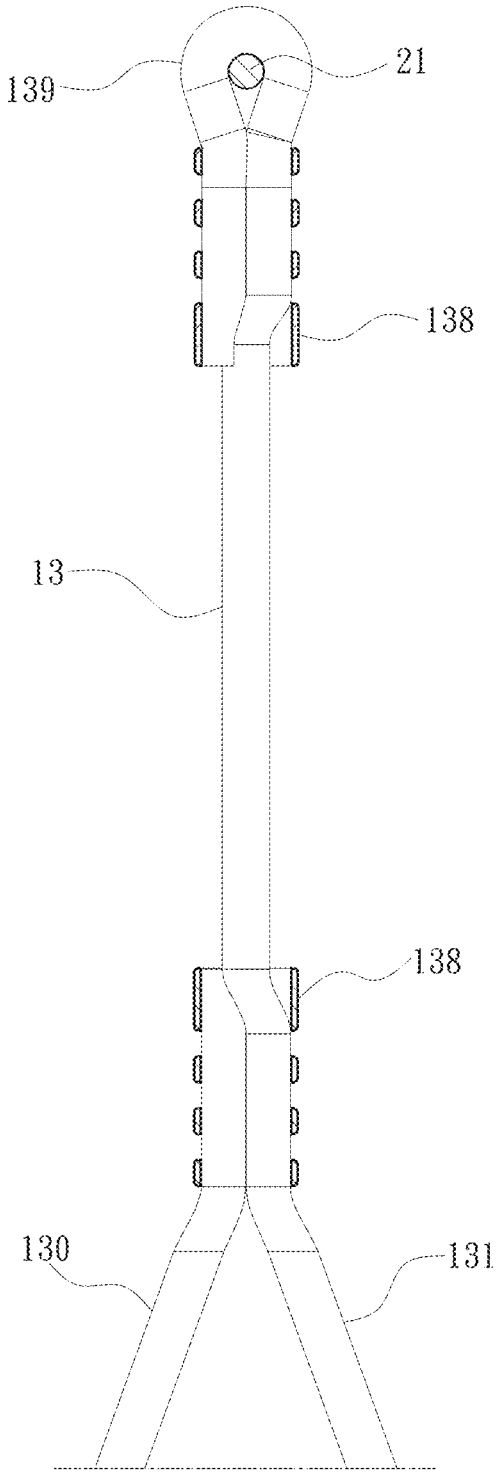
FIG. 2 is a first cross-sectional view of partial structure of one embodiment of the invention.
Figure 3:
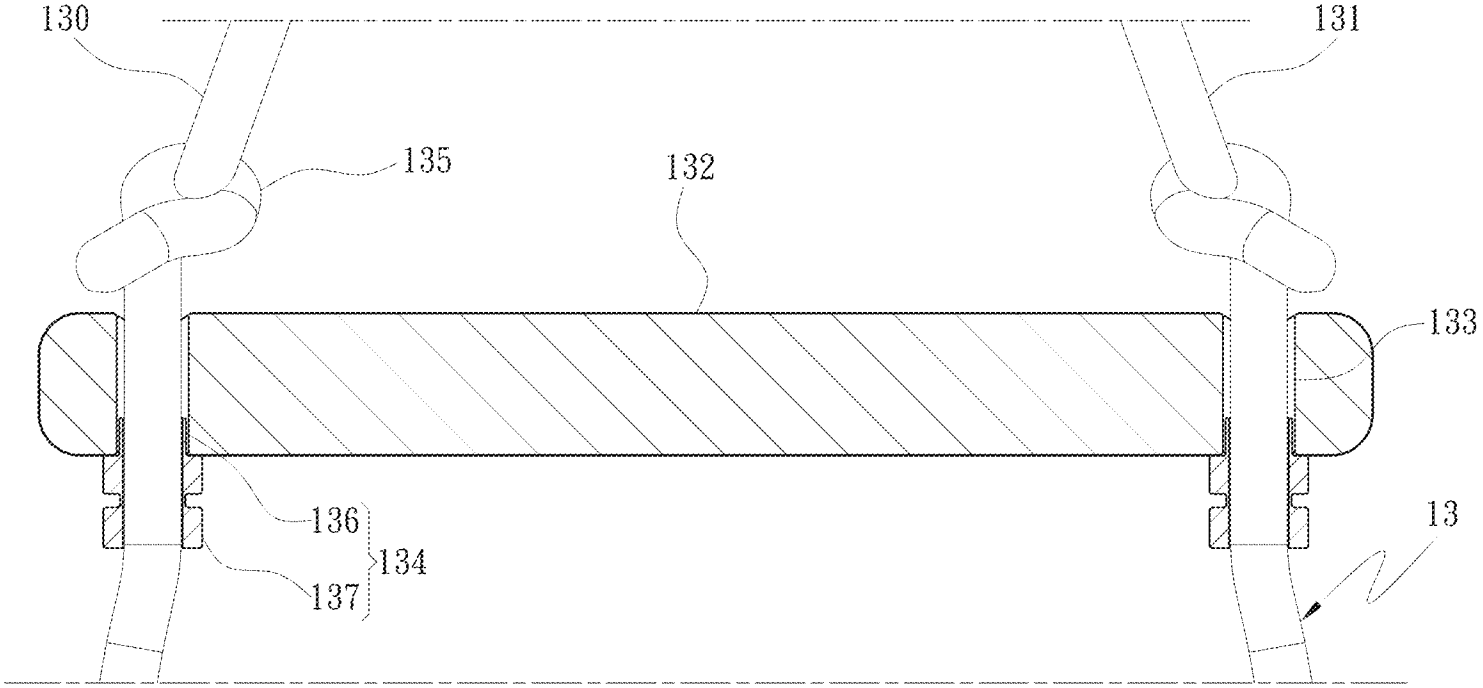
FIG. 3 is a second cross-sectional view of partial structure of one embodiment of the invention.
Figure 4:
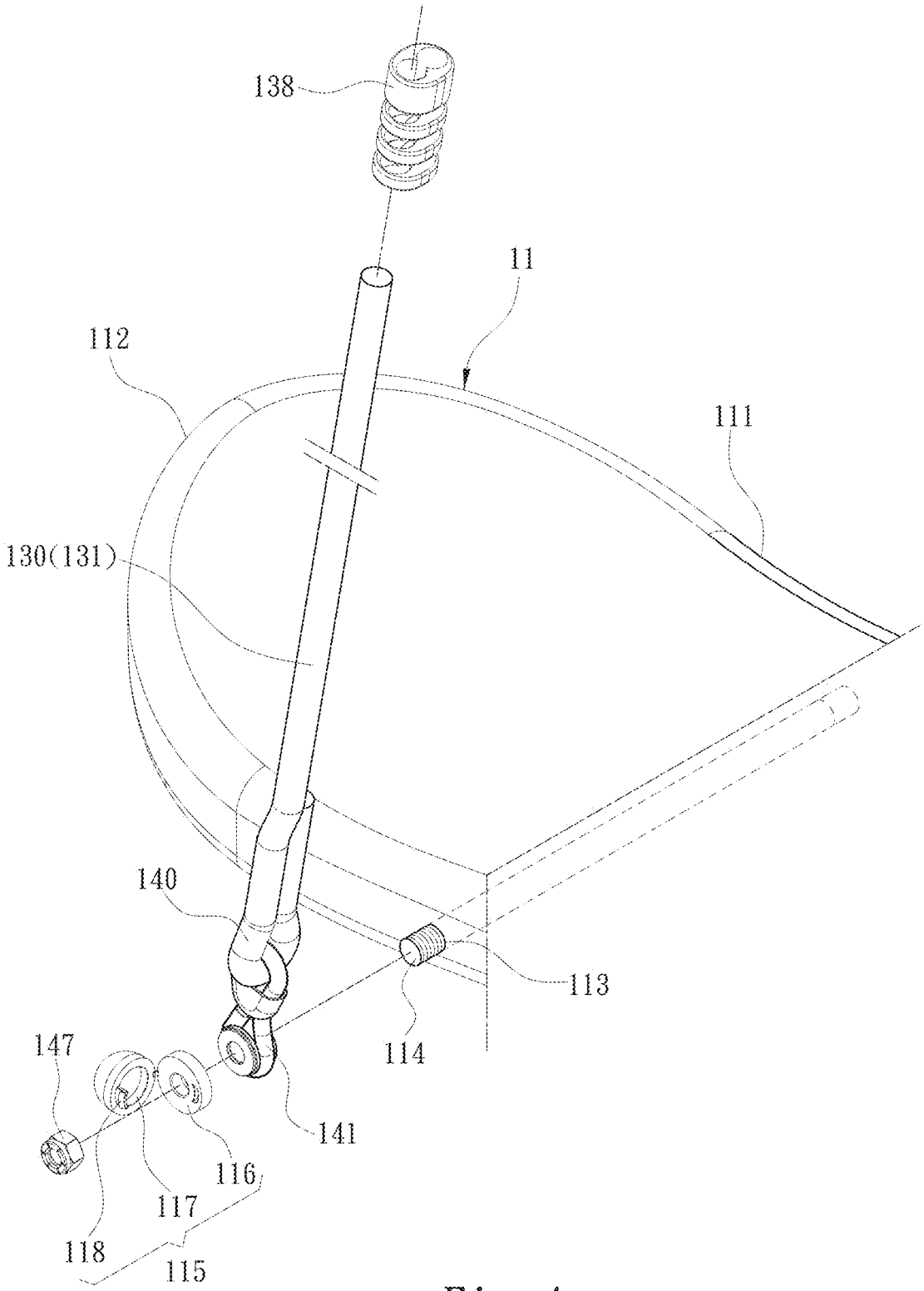
FIG. 4 is a perspective exploded view of partial structure of one embodiment of the invention.

The detailed description and technical content of the invention are described below with reference to the drawings.

Please refer to FIG. 1, FIG. 2, FIG. 3 and FIG. 4. The invention provides a swing 10 for playing in a standing posture. The swing 10 includes a step plate 11 and two suspension components 13, wherein the step plate 11 is elongated and defined with two long sides 111 and two short sides 112 along edges thereof. In addition, the two suspension components 13 are respectively disposed on the two long sides 111. Each of the two suspension components 13 includes two slings 130, 131 and a handle 132, wherein the two slings 130, 131 are disposed on one of the long sides 111 of the step plate 11, and the handle 132 is formed with two through holes 133 to respectively provide for the two slings 130, 131 passing through, so that the handle 132 is assembled with the two slings 130, 131 and is parallel to the long sides 111 of the step plate 11. Specifically, the handle 132 of the invention is merely provided for the two slings 130 131 passing through rather than being wound by the two slings 130, 131. That is, the two slings 130, 131 are not fastened with the handle 132 in a winding manner Each of the two slings 130 (131) includes a stop sleeve 134 and a knot 135, wherein the knot 135 is formed by winding and knotting the sling 130 (131), and the stop sleeve 134 is sleeved on the sling 130 (131) by passing from an end thereof. The stop sleeve 134 is not contacted with the knot 135 and spaced apart to provide for the handle 132 being disposed. The stop sleeve 134 is provided for the handle 132 to abut against thereon and stops the handle 132 to restrict a position of the handle 132 together with the knot 135 on the sling 130 (131) when a force bore by the stop sleeve 134 is less than a friction between the stop sleeve 134 and a surface of the sling 130 (131). Moreover, the stop sleeve 134 is capable of displacing upward and downward along the sling 130 (131) when the force bore by the stop sleeve 134 is greater than the friction between the stop sleeve 134 and the surface of the sling 130 (131), and a knotting position of the knot 135 is allowed to be changed, thereby adjusting a position of the handle 132 on the sling 130 (131).

Further, the swing 10 of the invention is hung on a suspension bar 20 for a user to play in a standing posture. Specifically, the two suspension components 13 respectively hung on the suspension bar 20, and the step plate 11 is provided for the user to step thereon. A height for disposal of the handle 132 is adjusted according to the user's requirements. The user is able to sway the body to force the step plate 11, so that the step plate 11 drives the two suspension components 13 being displaced back and forth on the basis of the suspension bar 20 as a center.

The invention does not adopt a conventional method that a sling winds around a handle to fasten the handle, but instead using the stop sleeve 134 and the knot 135 disposed on the sling 130 (131) to define a position for disposal of the handle 132. In other words, the user is able to move the stop sleeve 134 upward or downward along the sling 130 (131) by operating the stop sleeve 134 so as to change the position of the handle 132 on the sling 130 (131).

In one embodiment, please refer to FIG. 1, FIG. 2, FIG. 3 and FIG. 4, the stop sleeve 134 of the invention includes a sleeve 136 and at least one stop ring 137. The sleeve 136 is sleeved on the sling 130 (131) and inserted into one of the two through hole 133 to fix a position where the stop sleeve 134 is located on the handle 132. The stop ring 137 is connected to the sleeve 136 and located in an opposite direction of the handle 132, and an outer diameter of the stop ring 137 is larger than a pore size of the through hole 133, so that the stop ring 137 is provided for the handle 132 to abut against thereon, and the stop ring 137 restricts the handle 132 from falling off along the sling 130 (131) under gravitational force.

In addition, in one embodiment, please refer to FIG. 1, FIG. 2, FIG. 3 and FIG. 4, in each of the two suspension components 13, at least one bundling member 138 is provided in one of the two slings 130 (131). The bundling member 138 is disposed at a position higher than the handle 132 to restrict one end of the other one of the two slings 131 (130) so that the two slings 130, 131 are bundled and fastened. In this embodiment, a length of one of the two slings 130 (131) provided with the bundling member 138 is greater than a length of the other one of the two slings 131 (130) without providing with the bundling member 138. In addition, the swing 10 of the invention is suspended on the suspension bar 20, and a first sling loop 139 is formed at the sling 130 (131) which is provided with the at least one bundling member 138, the first sling loop 139 is disposed at one end of the sling 130 (131) where is not connected to the step plate 11, and the first sling loop 139 is used to assemble with a hanging hook 21 on the suspension bar 20. Further, in one embodiment, the first sling loop 139 is formed by winding one of the two slings 130, 131 or additionally sewed on one of the two slings 130, 131. In one embodiment that the first sling loop 139 is formed by sewing additionally, the first sling loop 139 is made by an elastic material such as an elastic rope or a nylon rope with a high coefficient of elasticity.

Figure 5:
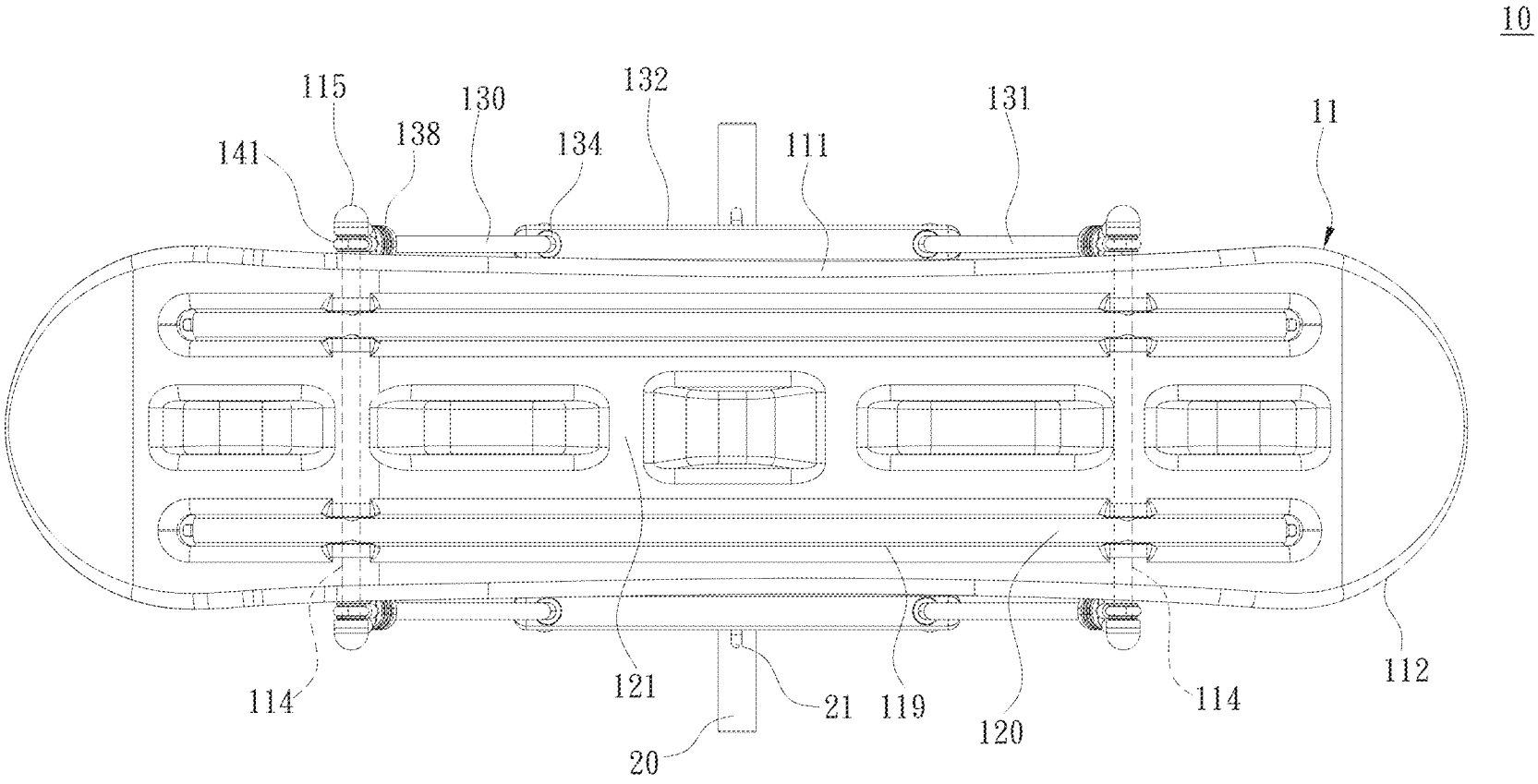
FIG. 5 is a first bottom view of one embodiment of the invention.

On the other hand, please refer to FIG. 1, FIG. 2, FIG. 3 and FIG. 4. In one embodiment, the step plate 11 is formed with two mounting holes 113 penetrating the long sides 111, and two mounting rods 114 respectively inserting in the two mounting holes 113 to pass through the step plate 11, as shown in FIG. 5. Each mounting rod 114 is partially exposed outside the mounting hole 113 after passing through the step plate 11. One end of the sling 130 (131) connected to the step plate 11 is formed with a second sling loop 140 and a connecting hook 141. The second sling loop 140 is formed in a same manner as the first sling loop 139 and thus will not be repeated here. One end of the connecting hook 141 is connected to the second sling loop 140, and the other end of the connecting hook 141 is connected to a part that each mounting rod 114 exposed outside each mounting hole 113, so that the sling 130 (131) is able to be assembled with the step plate 11 through the connecting hook 141. In one embodiment, the step plate 11 is further provided with two nuts 147 on each of the two long sides 111, and the nuts 147 are assembled with the part that the mounting rod 114 exposed outside the two mounting hole 113. Further, the step plate 11 of the invention includes two anti-collision covers 115 on each of the two long sides, and each anti-collision cover 115 disposes on the mounting rod 114. Each of the anti-collision covers 115 includes a ring 116 and a cover 117, wherein the ring 116 is sleeved on the mounting rod 114 and disposed on a side of the connecting hook 141 opposite to the step plate 11, so that the ring 116 is used to stop the connecting hook 141 from falling off from the mounting rod 114. In addition, the cover 117 corresponds to the ring 116 and is partially assembled on the ring 116, so that the cover 117 is able to be opened and closed relative to the ring 116. When the cover 117 is operated to cover the ring 116, one end of the mounting rod 114 exposed outside of each of the two mounting holes 113 where the ring 116 sleeved is also covered so as to prevent the user from accidentally colliding with each of the two mounting rods 114, and prevent the connecting hook 141 from falling off simultaneously. In this embodiment, each anti-collision cover 115 further includes a limiting structure 118 to be used for limiting the cover 117 and avoiding the cover 117 being opened relative to the ring 116 when the cover 117 is not operated.

On the other hand, although the swing provided by the U.S. Pat. No. 9,511,296B is also used by a user to play in a standing posture, the patent does not reveal that the step plate 11 includes a structural reinforcement material. The conventional step plate is unable to bear a weight of the user and prone to break due to insufficient structural strength. In contrast, the step plate 11 of the invention provides an excellent strength to bear a weight of the user, and the step plate 11 is provided for the user to repeatedly step thereon at the same time. In one embodiment, please refer to FIG. 5 and FIG. 6, the step plate 11 is provided with two grooves 119 on a plane without facing the two handles 132, and two supporting ribs 120 which are respectively disposed in the two grooves 119. The two grooves 119 are elongated and disposed to parallel the long sides 111 of the step plate 11, and the supporting ribs 120 are also elongated to be disposed in the two grooves 119, so that the two supporting ribs 120 specifically strengthen a structural strength of the step plate 11. Further, the step plate 11 is formed with at least one auxiliary rib 121 on the plane without facing the two handles 132. The at least one auxiliary rib 121 is disposed at intervals to assist the step plate 11 in distributing the user's weight, so as to prevent an acting force generated by the user's weight from being over-concentrated at a certain position of the step plate 11.

Figure 6:
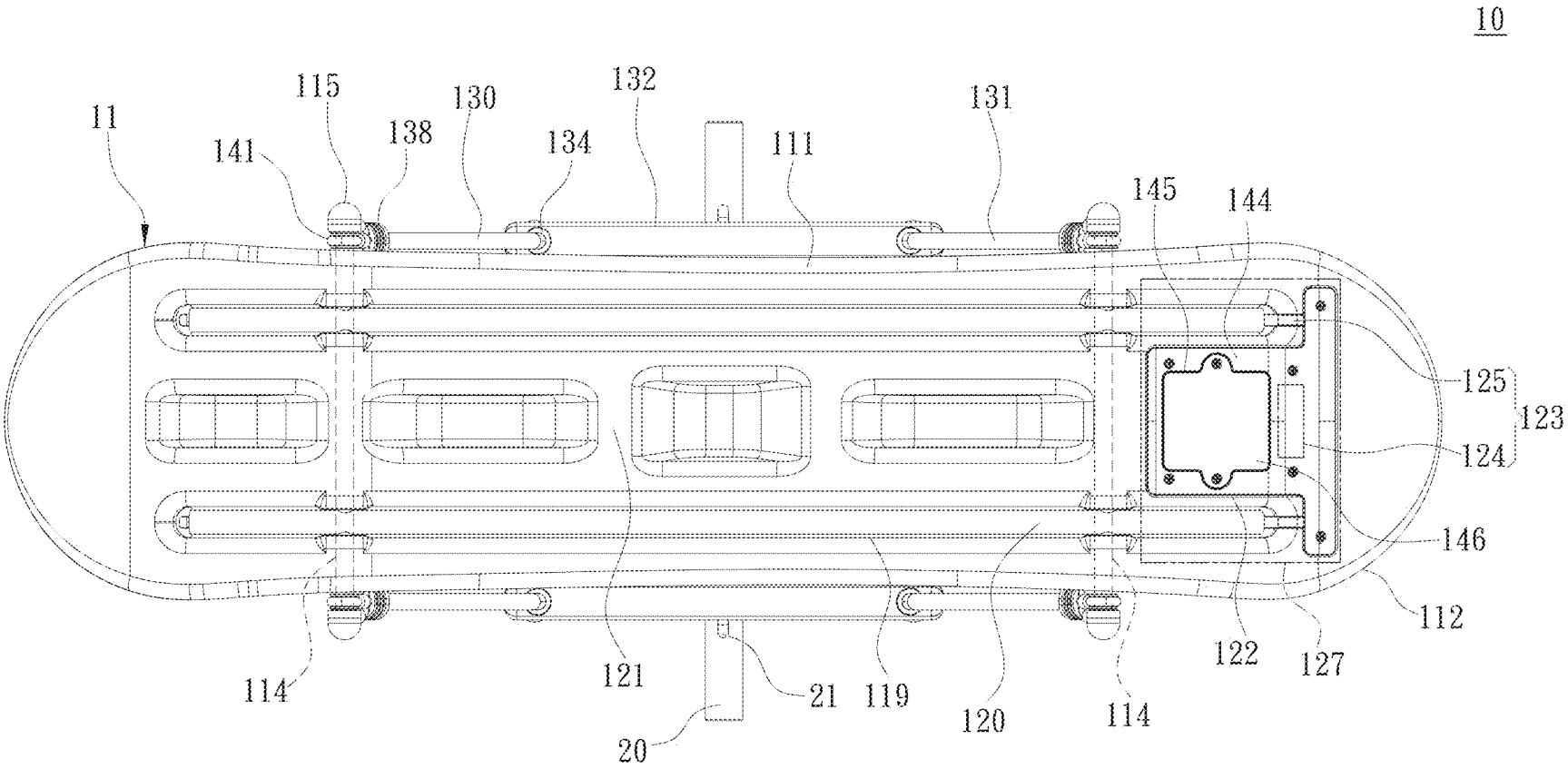
FIG. 6 is a second bottom view of one embodiment of the invention.
Figure 7:
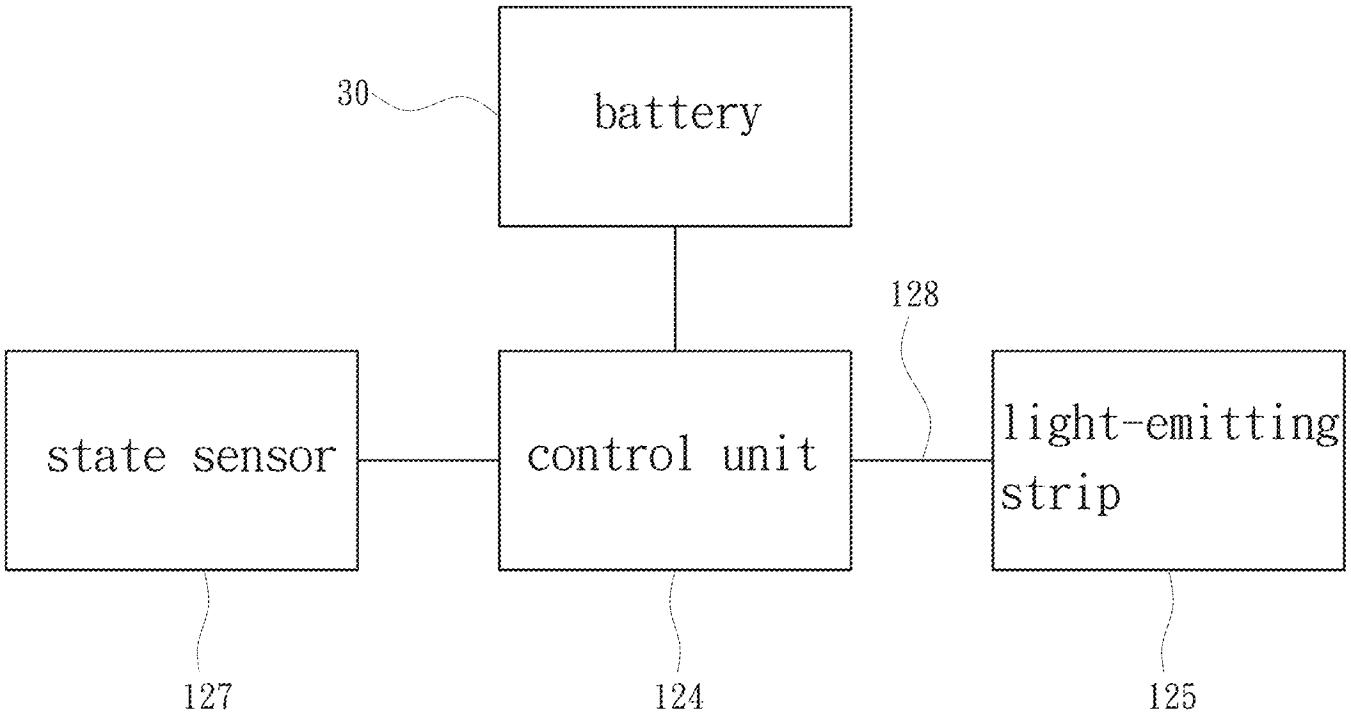
FIG. 7 is a block diagram of structural units of one embodiment of the invention.
Figure 8:
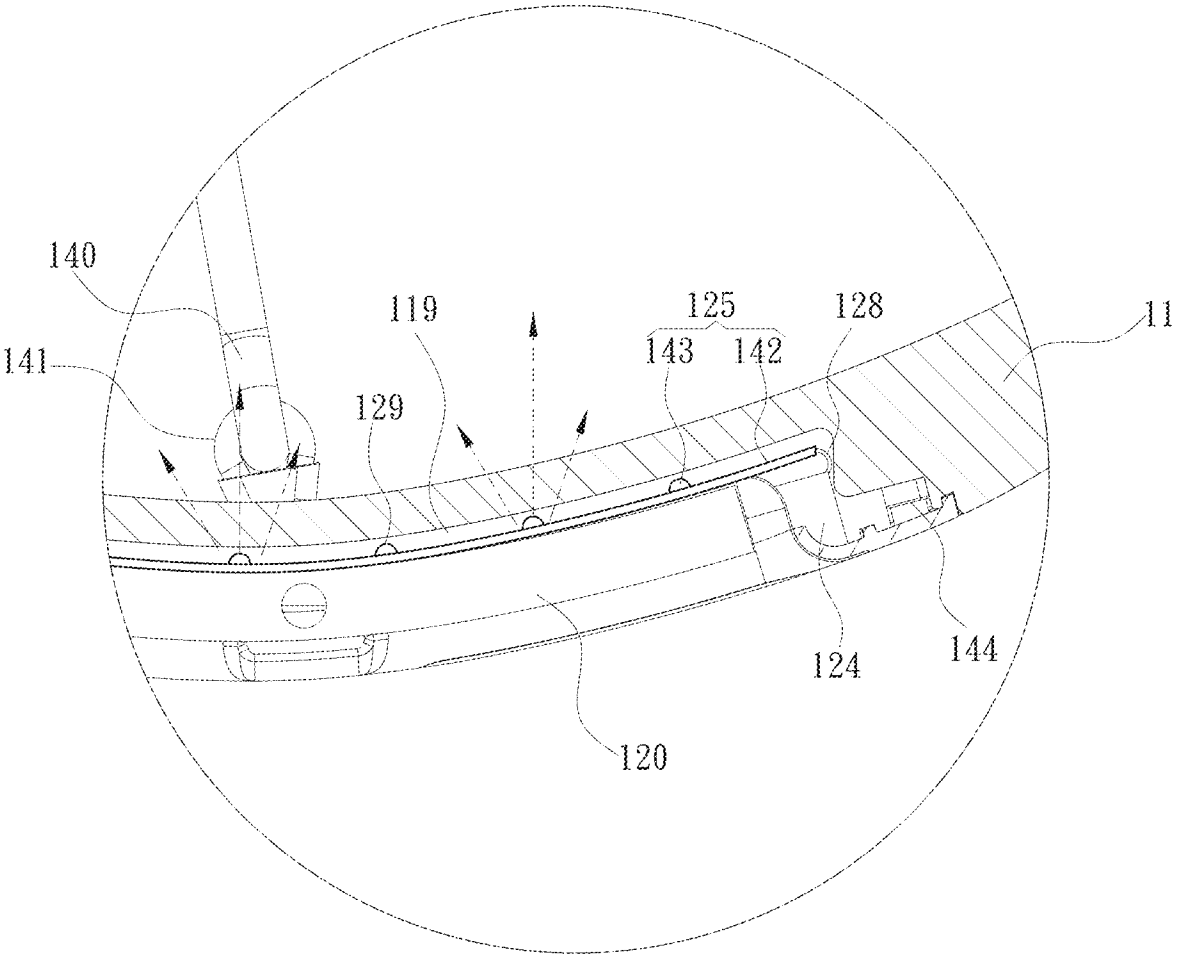
FIG. 8 is a third cross-sectional view of partial structure of one embodiment of the invention.

Please refer to FIG. 6, FIG. 7 and FIG. 8. In one embodiment, in order to increase the entertainment effect of the invention, the step plate 11 is provided with an accommodating groove 122 on the plane without facing the two handles 132, and a light-emitting module 123 disposed in the accommodating groove 122. In one embodiment, the light-emitting module 123 includes at least one control unit 124 disposed in the accommodating groove 122, and at least one light-emitting strip 125 electrically connected to the at least one control unit 124 and located in one of the two grooves 119. In addition, one of the two supporting ribs 120 is stacked on the light-emitting strip 125, so that a position of the light-emitting strip 125 is restricted by one of the two supporting ribs 120. Also, the light-emitting strip 125 includes a light-emitting surface 129 facing one of the two grooves 119, and the light-emitting strip 125 is controlled by the control unit 124 to determine whether to project light or not. The light-emitting surface 129 projects light toward the groove 119 after the light-emitting strip 125 is driven by the control unit 124, as shown in FIG. 7. Further, in one embodiment, the light-emitting strip 125 is composed of a strip-shaped carrier 142 and a plurality of light-emitting diodes 143 disposed on the strip-shaped carrier 142 at intervals, and the strip-shaped carrier 142 is provided with appropriate flexibility such as that of flexible circuit board. On the other hand, the light-emitting diodes 143 is implemented as light-emitting diodes of different colors, or implemented as RGB light-emitting diodes.

Further, in one embodiment, the step plate 11 of the invention further includes a state sensor 127, and the state sensor 127 can be a gyroscope, an acceleration sensor, or a vibration transducer. The state sensor 127 is electrically connected to the control unit 124 to send out signals based on a current sensed status, so that the control unit 124 changes a light projection mode of the light-emitting strip 125 based on the signals being received. The light projection mode can be continuous light emitting, or flicker light emitting. Taking the state sensor 127 as a vibration transducer for example, when the state sensor 127 is shaken by the user, the control unit 124 receives signals sent from the state sensor 127, and the control unit 124 controls a light projection state of the light-emitting strip 125 based on the signals being currently received in comparison with an activation condition of control mode stored in the control unit 124. Further, the activation condition of control mode can be variations of signals or a variation number of the signals. In one embodiment, the control unit 124 includes at least one wire 128 connected to the light-emitting strip 125. In another embodiment, the step plate 11 of the invention is made of a light-transmitting material such as thermoplastic polyurethanes (TPU) material, polycarbonate (PC) material, and poly(methyl methacrylate) (PMMA) material. When the at least one light-emitting strip 125 emits light, a side of the at least one light-emitting strip 125 without facing the step plate 11 is shielded by the supporting rib 120, so that the light is transmitted from the step plate 11 to the outside after the light-emitting strip 125 is controlled to generate light.

Please refer to FIG. 6, FIG. 7 and FIG. 8. In one embodiment, the step plate 11 of the invention includes a cap 144 disposed in the accommodating groove 122. The cap 144 closes the accommodating groove 122 while prevents the control unit 124 from falling off from the accommodating groove 122. Further, the cap 144 is formed to provide with a battery cover opening 145 where at least one battery 30 is disposed therein, and a battery cover 146 is connected to the battery cover opening 145, wherein the battery 30 is electrically connected to the control unit 124 and used to supply power to the light-emitting module 123. In addition, the battery cover 146 is assembled on the battery cover opening 145 to cover and prevent the at least one battery 30 from falling off.

Figure 9:
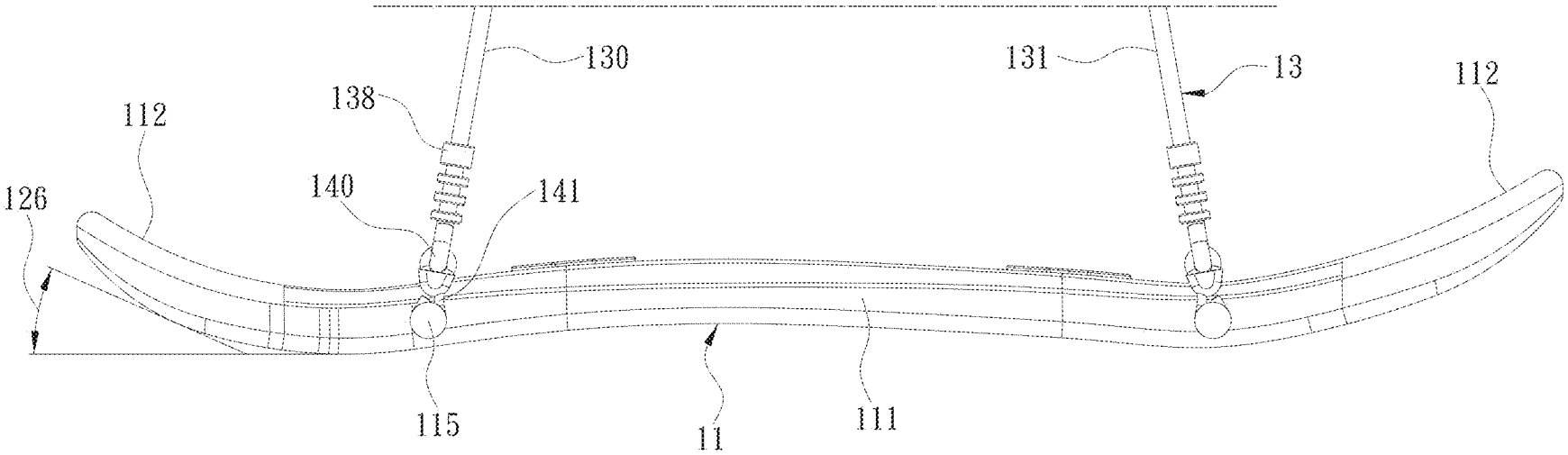
FIG. 9 is a side view of partial structure of one embodiment of the invention.

On the other hand, please refer to FIG. 9. When the step plate 11 of the invention is viewed from one of the two long sides 111, two ends of the step plate 11 are upwardly warped relative to a central part of the step plate 11, that is, the step plate 11 includes an upward tilt angle 126 at the two ends respectively. In addition, the central part of the step plate 11 of the invention is in any shape according to design requirements, such as flat and straight shape, or wavy shape as shown in FIG. 9 of the invention.

What is claimed is:

1. A swing for playing in standing posture, comprising:

a step plate, defined with two long sides and two short sides along edges of the step plate; and two suspension components, respectively disposed on the two long sides, and each of the suspension components including two slings disposed on one of the long sides of the step plate, and a handle assembled with the two slings and parallel to the long sides, the handle formed with two through holes for the two slings to pass through, wherein the two slings do not wound around the handle at any part thereof, and each of the two slings comprises a stop sleeve and a knot, the stop sleeve moves along the sling if a force bore by the stop sleeve is greater than a friction between the stop sleeve and a surface of the sling, and a position of the handle on the sling is defined by the stop sleeve and the knot.

2. The swing for playing in standing posture as claimed in claim 1, wherein the stop sleeve comprises a sleeve and at least one stop ring connected with the sleeve, and the sleeve is sleeved on the sling and inserted into one of the two through holes.

3. The swing for playing in standing posture as claimed in claim 1, wherein one of the two slings of each suspension component is provided with at least one bundling member which is disposed at a position higher than the handle to restrict one end of the other one of the two slings.

4. The swing for playing in standing posture as claimed in claim 3, wherein one of the two slings provided with the bundling member is formed with a first sling loop at one end that is not assembled with the step plate, and the first sling loop is used to assemble with a hanging hook.

5. The swing for playing in standing posture as claimed in claim 4, wherein the step plate is provided with two mounting rods passing through the step plate, and one end of each of the slings connecting with the step plate is provided with a connecting hook assembled with one of the mounting rods.

6. The swing for playing in standing posture as claimed in claim 5, wherein one end of each of the slings which is close to the step plate is formed with a second sling loop to assemble with the connecting hook.

7. The swing for playing in standing posture as claimed in claim 1, wherein the step plate is provided with two grooves parallel to the two long sides on a plane without facing the two handles, and two supporting ribs disposed in the two grooves respectively.

8. The swing for playing in standing posture as claimed in claim 7, wherein the step plate is formed with an accommodating groove on the plane without facing the two handles, and the step plate comprises a light-emitting module disposing in the accommodating groove, and the step plate is made of a light-transmitting material.

9. The swing for playing in standing posture as claimed in claim 8, wherein the light-emitting module includes a control unit disposed in the accommodating groove, and at least one light-emitting strip disposed in one of the two grooves, each of the supporting ribs is stacked on the light-emitting strip, and the light-emitting strip comprises a light-emitting surface facing the groove.

10. The swing for playing in standing posture as claimed in claim 8, wherein two ends of the step plate respectively comprise an upward tilt angle while viewing the step plate from one of the long sides.

11. The swing for playing in standing posture as claimed in claim 8, wherein the step plate is wavy, and two ends of the step plate respectively comprise an upward tilt angle while viewing the step plate from one of the long sides.

* * * * *